US009523549B1

(12) United States Patent
Hughes

(10) Patent No.: US 9,523,549 B1
(45) Date of Patent: Dec. 20, 2016

(54) CROSSBOW TRIGGER MECHANISM

(71) Applicant: Bear Archery, Inc., Evansville, IN (US)

(72) Inventor: Andrew Hughes, Evansville, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 14/997,637

(22) Filed: Jan. 18, 2016

Related U.S. Application Data

(60) Provisional application No. 62/151,600, filed on Apr. 23, 2015.

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01); *F41B 5/123* (2013.01)

(58) Field of Classification Search
CPC ..... F41B 5/12; F41B 5/1469
See application file for complete search history.

(56) References Cited

U.S. PATENT DOCUMENTS

| | | | | |
|---|---|---|---|---|
| 4,009,703 | A * | 3/1977 | Cunningham, Sr. | F41B 5/1438 124/35.2 |
| 4,066,060 | A * | 1/1978 | Napier | F41B 5/1469 124/35.2 |
| 4,083,348 | A * | 4/1978 | Fletcher | F41B 5/1469 124/35.2 |
| 4,316,443 | A * | 2/1982 | Giacomo | F41B 5/1469 124/35.2 |
| 5,085,200 | A | 2/1992 | Horton-Corcoran et al. | |
| 5,649,520 | A | 7/1997 | Bednar | |
| 6,425,386 | B1 | 7/2002 | Adkins | |
| 7,770,567 | B1 | 8/2010 | Yehle | |
| 7,810,480 | B2 | 10/2010 | Shepley et al. | |
| 8,020,543 | B2 | 9/2011 | Maleski et al. | |
| 8,091,540 | B2 * | 1/2012 | Matasic | F41B 5/12 124/25 |
| 8,651,094 | B2 | 2/2014 | Matasic et al. | |
| 8,899,218 | B2 | 12/2014 | Kempf | |
| 8,997,729 | B1 * | 4/2015 | Gillig | F41B 5/1469 124/35.2 |
| 2009/0078243 | A1 | 3/2009 | Bednar et al. | |
| 2014/0174419 | A1 | 6/2014 | McPherson et al. | |
| 2014/0182574 | A1 | 7/2014 | Darlington et al. | |
| 2014/0246003 | A1 | 9/2014 | Lipowski | |

* cited by examiner

*Primary Examiner* — John Ricci
(74) *Attorney, Agent, or Firm* — Charles Meyer; Woodard, Emhardt et al.

(57) ABSTRACT

Certain embodiments of the present disclosure describe a trigger assembly for a crossbow. The trigger assembly may include a trigger pull weight adjustment mechanism that allows a user to adjust the trigger pull weight of the crossbow.

20 Claims, 11 Drawing Sheets

CROSSBOW TRIGGER MECHANISM

The present application claims priority to provisional application Ser. No. 62/151,600 filed on Apr. 23, 2015.

FIELD OF THE INVENTION

Aspects of the present invention deal with crossbows, and in particular deal with trigger assemblies for use in crossbows.

BACKGROUND OF THE INVENTION

Crossbows have been used for centuries for both hunting and recreation. They are typically characterized by horizontal limbs mounted on a stock with a bowstring that is drawn to store energy that is transferred to a bolt upon firing. The bowstring is held in a string catch that holds the bowstring until the user is ready to fire. When the user is ready to shoot the bolt, the user pulls a trigger. Upon pulling the trigger, a series of interactions occurs between components of a trigger assembly, allowing the bowstring to be released from the string catch and allowing transfer of stored energy in the bowstring to the bolt.

There are several different designs of crossbows. A recurve crossbow has a bowstring attached directly to limbs that extend from the body of the crossbow. When the bowstring is drawn, the limbs deflect and store potential energy that is transferred to the bowstring and a loaded arrow when the crossbow is fired. A compound crossbow has a set of wheels or cams attached to its limbs. A cabling system attached to the wheels or cams is used to assist in bending the limbs as the bowstring is drawn.

SUMMARY OF THE INVENTION

Certain embodiments of the present disclosure deal with a trigger assembly in a crossbow. The trigger assembly includes a trigger mechanism, a cable catch assembly, and a safety mechanism. Some embodiments include an adjustable trigger weight mechanism.

The trigger mechanism includes a trigger that is attached to a sear that contacts a bearing attached to the cable catch assembly. Cocking the crossbow causes a string nut in the cable catch assembly to rotate. When the crossbow is cocked, the string nut retains the crossbow cable and a bolt is loaded. When the user pulls the trigger, it causes the sear to rotate and lose contact with the bearing attached to the string nut. The force from the crossbow cable on the string nut causes the string nut to rotate and release the cable to fire the bolt.

Certain embodiments may include a trigger pull weight adjustment mechanism that allows a user to manually adjust the trigger pull weight. A biasing member is positioned between a stop and a pusher member. The stop is adjustable. The pusher member contacts a rearward flange of the sear and biases the sear to a normal, unfired position. The user has access to adjust the position of the stop. Adjusting the position of the stop adjusts the amount of preload on the biasing member against the pusher member and thus the trigger. Increasing the preload increases the trigger pull weight, while decreasing the preload decreases the trigger pull weight.

An illustrated embodiment demonstrates an assembly comprising a crossbow stock with a pair of limbs extending from respective sides of the stock. A bowstring cable extends between the limbs. A trigger assembly is arranged with the stock and is operable to hold and release the bowstring cable from a drawn position. The trigger assembly has a cable catch assembly and a trigger mechanism including a trigger selectively operable in a pull direction to release the cable catch assembly to release the bowstring cable. The trigger assembly further includes a trigger pull weight adjustment mechanism including a pusher member biased by a resilient force against a portion of the trigger mechanism against the pull direction. The resilient force applied against the pusher member is adjustable to change the trigger pull weight of the trigger.

In certain embodiments a compressible spring applies the resilient force against the pusher member. Certain versions include an adjustable stop, wherein the spring is arranged in compression between the stop and the pusher member, and the position of the stop is movable to adjust the force applied by the spring against the pusher member. The position of the stop may be adjusted with a tool inserted into an access hole or alternately using a wheel adjustment assembly.

In certain alternate embodiments, a trigger assembly is mountable with a crossbow stock and contains a cable catch assembly and a trigger mechanism including a trigger selectively operable in a pull direction to release the cable catch assembly to release a crossbow bowstring cable. The trigger assembly also includes a trigger pull weight adjustment mechanism including a resiliently biased pusher member bracing a portion of the trigger mechanism against the pull direction. The resilient force applied against the pusher member is adjustable to change the trigger pull weight of the trigger.

Still further illustrated is an assembly comprising a crossbow stock, a pair of limbs extending from respective sides of the stock and a bowstring cable extending between the limbs. A trigger mechanism is arranged in the stock and is selectively operable in a pull direction to release the bowstring cable. A compressible spring is arranged between a stop and the trigger mechanism and resiliently biases the trigger mechanism against the pull direction. The stop is selectively adjustable to control the biasing force of the spring against the trigger mechanism.

DESCRIPTION OF PREFERRED EMBODIMENTS

Figure 1:
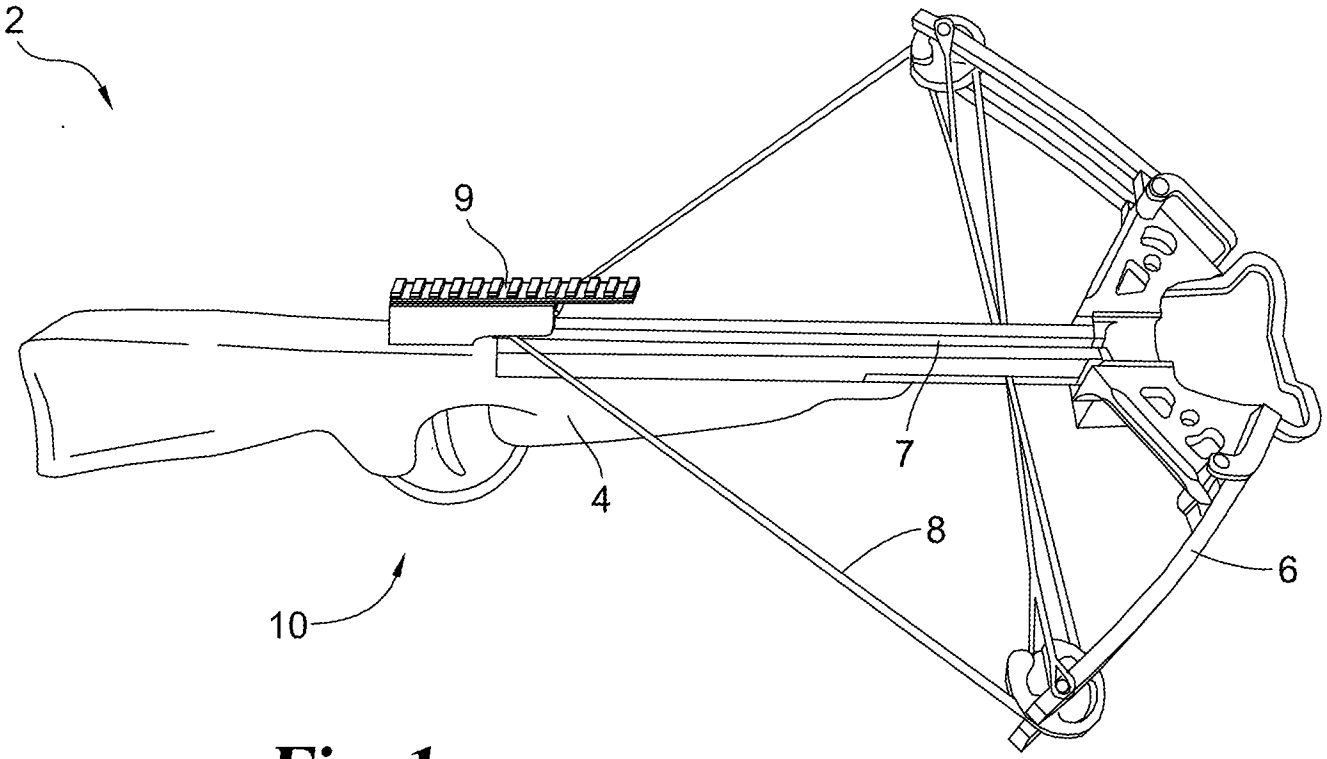
FIG. 1 is a perspective view of a representative crossbow including an embodiment of a trigger assembly.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Certain embodiments shown in FIGS. 1-17 include a crossbow trigger assembly that includes a trigger mechanism, a cable catch assembly, and a safety mechanism. A trigger is connected to a sear that contacts a rotatable bearing connected to a string nut. A rotatable safety lever prohibits rotation of the sear when the safety mechanism is engaged. A bowstring cable may be cocked and held against the string nut. When the safety mechanism is disengaged, the sear is allowed to rotate upon a user pulling on the trigger. Rotation of the sear causes the sear to disengage from the rotatable bearing. Forward force from the bowstring cable on the string nut causes the string nut to rotate and release the bowstring cable, causing a bolt to be fired.

Some embodiments of the crossbow trigger mechanism include a trigger pull weight adjustment mechanism. The trigger pull weight adjustment mechanism may include a biasing member such as a spring located between a stop and a pusher member. The pusher member pushes downward on a rearward flange of the sear, providing resistance when the trigger is pulled. In alternate embodiments, the biasing member may directly engage trigger mechanism, for example by directly engaging the sear.

An adjustment piece controls the stop. The adjustment piece is accessible, so a user may adjust the position of the stop to change the preload force on the spring. Increasing the preload force makes the spring harder to compress and increases the pull weight of the trigger, while decreasing the preload force decreases the pull weight.

FIG. 1 representatively illustrates a crossbow 2 which generally includes a stock 4. A pair of limbs 6 extends from respective sides of stock 4, and typically a rail 7 sits on top of stock 4. Typically limbs 6 are flexible. A bowstring cable 8 extends between limbs 6 and is shown in FIG. 1 in the drawn or cocked position. Optionally, bowstring cable 8 may be arranged on a cam system to extend between limbs 6. A trigger assembly 10 is arranged with stock 4. Trigger assembly 10 is mounted into stock 4 and is used to hold and then release bowstring 8 from the drawn position, firing an arrow/bolt when a bolt is loaded onto rail 7. Trigger assembly 10 is useful with various variations of crossbows, including recurve and compound bows, and may be used in conjunction with other accessories attached to the crossbow. An accessory rail 9 may be attached to the top of trigger mechanism 10 and may be used as a mounting point for accessories such as a scope or a light. For reference, the term forward is used to describe the direction in which an arrow/bolt is fired and the term rearward is defined to be the opposite direction.

Figure 2:
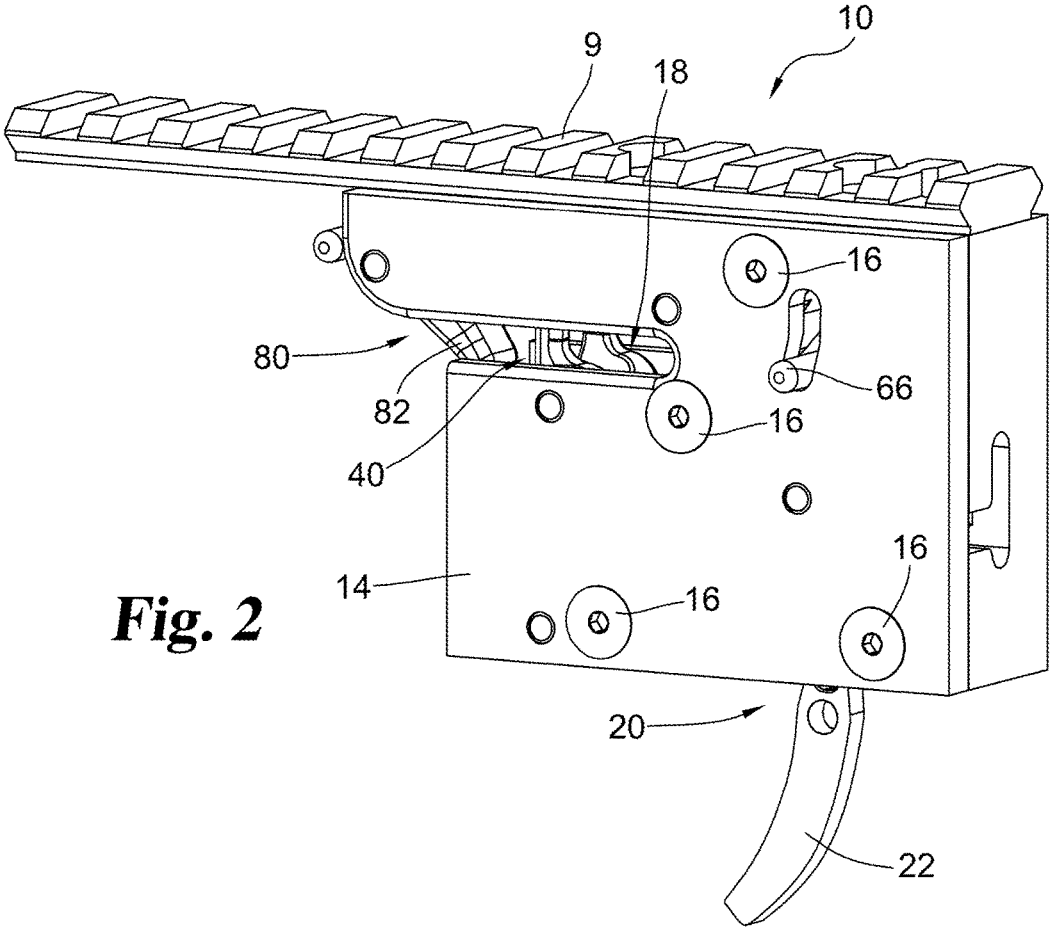
FIG. 2 is a perspective exterior view of an embodiment of a trigger assembly.
Figure 3:
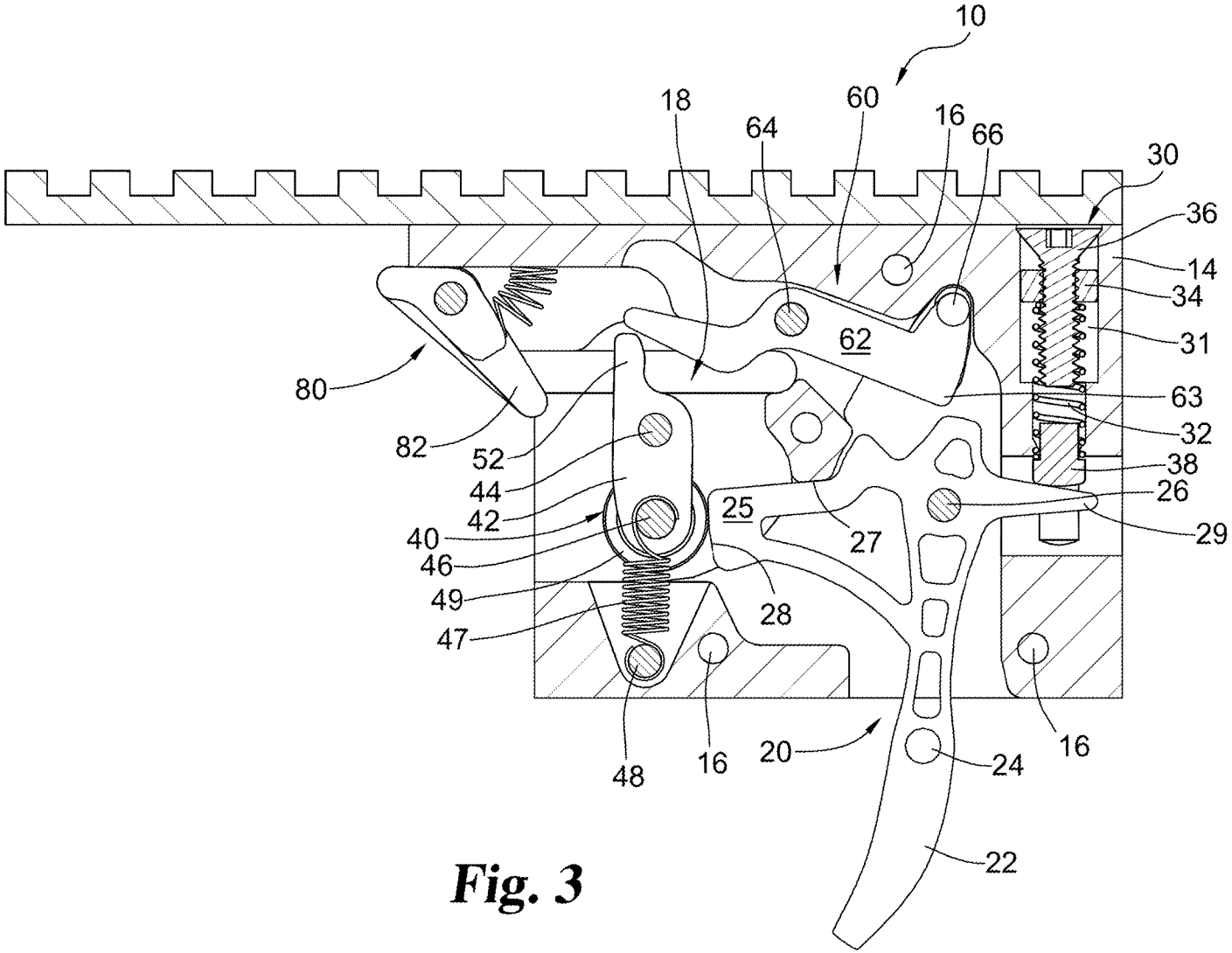
FIG. 3 is a side view of the trigger assembly of FIG. 2 in an uncocked position.

FIGS. 2-3 illustrate an example of a crossbow trigger assembly generally designated as 10. Generally, a housing 14 encloses the components of crossbow trigger assembly 10. Housing 14 may be monolithic, or may be constructed of several pieces attached together. The components enclosed in housing 14 include a trigger mechanism 20, a cable catch assembly 40, a safety mechanism 60, and an anti-dry fire assembly 80. Housing 14 also includes a cable slot 18 where bowstring cable 8 is inserted when cocking crossbow 2.

Crossbow trigger assembly 10 is generally attached to the stock of a crossbow. In use, cable catch assembly 40 retains a drawn bowstring, and a user pulls on trigger mechanism 20 to release the bowstring from cable catch 40, firing a loaded bolt from the crossbow. Attachment holes 16 provide points at which trigger assembly 10 is secured to the crossbow stock. In the embodiment shown, there are four attachment holes on the visible side; however, other embodiments may have more or fewer holes or other methods of attachment.

Within this description, the terms clockwise and counterclockwise may be used to describe the direction of rotation of various elements of trigger assembly 10. The use of these terms applies to the views in the figures that are referenced and is not intended to be limiting. The use of different views of trigger assembly 10 or alternate embodiments of trigger assembly 10 may have rotation in an opposite direction.

FIG. 3 shows the interior details of an example of trigger assembly 10 in an uncocked position. Some portions of housing 14 have been removed to show the inner components contained within trigger assembly 10. Trigger mechanism 20 includes a trigger 22 that extends from housing 14 to be pulled by a user. The top portion of trigger 22 is connected to or integral with the bottom portion of sear 25 at an attachment point 24. Sear 25 is rotatably mounted to housing 14 at sear pivot 26. A portion of sear 25 extends forward from pivot 26. A contact edge 27 of sear 25 contacts housing 14 when trigger assembly 10 is in a pre-firing position and limits clockwise rotation. Sear 25 also has a forward edge 28 adjacent the cable catch assembly 40. Another portion of sear 25 extends rearward from pivot 26 as a rearward flange 29.

Figure 4:
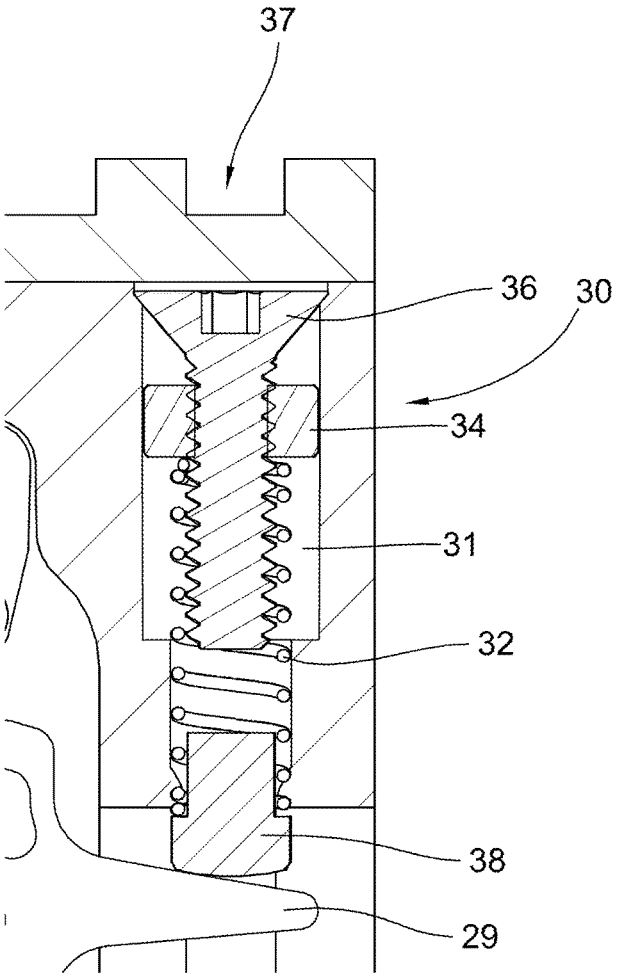
FIG. 4 is a side view of the trigger pull weight adjustment mechanism of the trigger assembly of FIG. 3.

A trigger pull weight adjustment mechanism 30 is positioned within housing 14, rearward of trigger mechanism 20. As seen in FIG. 4, trigger pull weight adjustment mechanism 30 includes a biasing member, for example, a trigger weight spring 32. The upper portion of trigger weight spring 32 abuts a stop 34. Stop 34 is constrained to travel within channel 31 and shaped to prevent rotation. In the embodiment shown, channel 31 is a vertical channel and stop 34 is constrained to move only vertically. In other embodiments, channel 31 may be any shape that allows stop 34 to apply a compressive force to trigger weight spring 32.

An adjustment piece 36 is engaged with stop 34. As an example, adjustment piece 36 may be a screw or bolt that is threadably engaged with stop 34 within housing 14. As one example, adjustment piece may have a screw or bolt head captured at a fixed height within vertical channel 31. In some versions, adjustment piece may have a keyed upper surface, for example to receive a screwdriver or hex/Allen wrench. In some embodiments, adjustment piece 36 may extend partially through and may assist in anchoring and aligning a portion of trigger weight spring 32.

The bottom portion of trigger weight spring 32 abuts and braces a an upper surface of pusher member 38. Spring 32 is arranged in compression between stop 34 and pusher member 38, applying a resiliently biasing force against pusher member 38. Pusher member 38 is shown with a lower surface adjacent to and abutting rearward flange 29 of sear 25. Alternately, the pusher member can be integrated with a portion of the sear or the biasing force can be directly applied against the sear.

Trigger pull weight adjustment mechanism 30 allows a user to adjust the amount of force required to pull the trigger mechanism 20 and release cable 8 to fire a bolt. Trigger weight spring 32 is located between stop 34 and pusher member 38. Spring 32 is biased to resiliently push pusher member 38 downward against rearward flange 29. Resiliently biased as used herein means that a user can apply force sufficient to cause the mechanism to move in the direction against the bias. As illustrated in FIG. 3, when a user pulls on trigger 22, rearward flange 29 moves upward as sear 25 rotates counterclockwise. As rearward flange 29 moves upward, it applies upward force on pusher member 38, moving the pusher member 38 upward against the biasing force applied by spring 32. The resistance applied by spring 32 increases as the spring is compressed. When the trigger is released, the biasing force propels the trigger to its original position.

Figure 5:
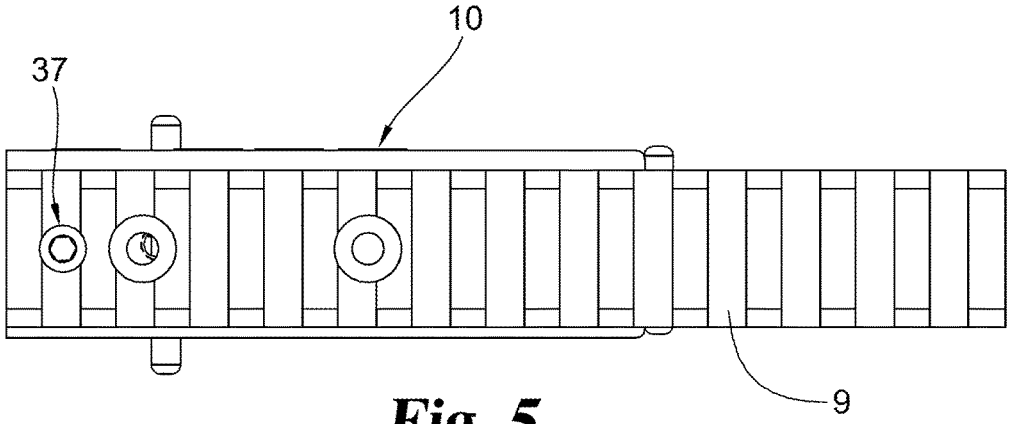
FIG. 5 is a top view of the crossbow of FIG. 1.

The top of housing 14 defines an access hole 37 that allows a user access to the top of adjustment piece 36 (see FIG. 5). Access hole 37 is large enough to allow a tool such as a screwdriver or an Allen wrench to be inserted to turn adjustment piece 36. In other embodiments, adjustment piece 36 may be turned without the aid of a tool. For example, adjustment piece 36 may include a knob that protrudes or which is accessible from the exterior of housing 14 and which may be turned by a user. Because adjustment piece 36 and stop 34 are threadably connected with adjustment piece 36 fixed in height and stop 34 does not rotate, turning adjustment piece 36 adjusts the position of stop 34 within channel 31. If the position of stop 34 is adjusted downward, the preload on the spring is increased, so it will take more force to compress spring 32 and the trigger pull weight is increased. Conversely, if the position of stop 34 is adjusted upward, the preload on the spring is decreased and the trigger pull weight is decreased.

Figure 6:
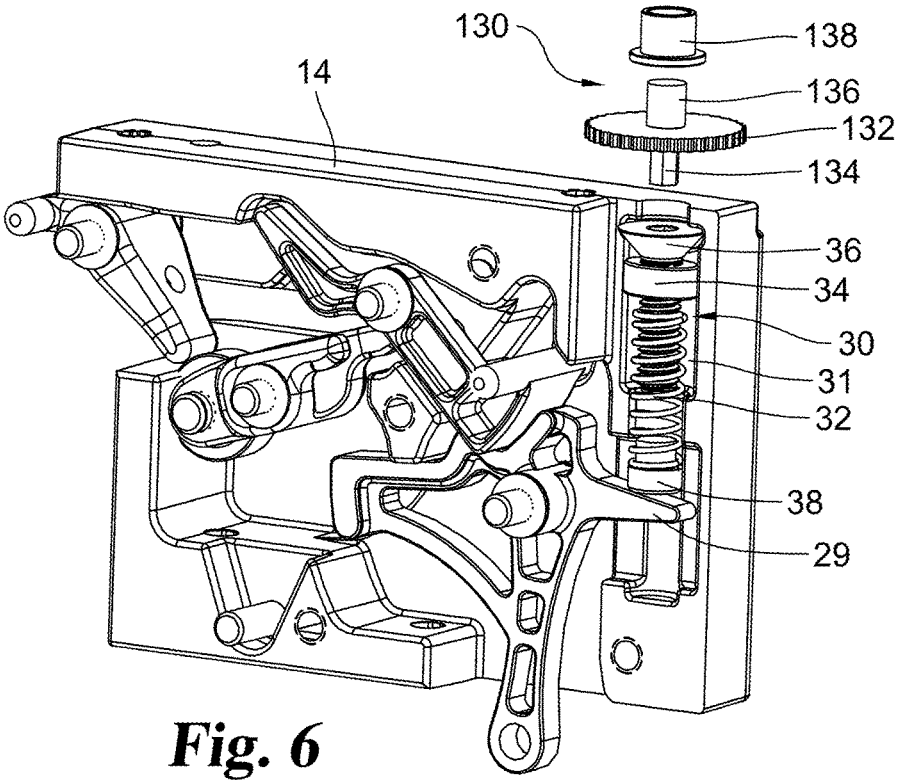
FIG. 6 is an exploded perspective view of an alternative embodiment of a trigger pull weight adjustment mechanism.
Figure 7:
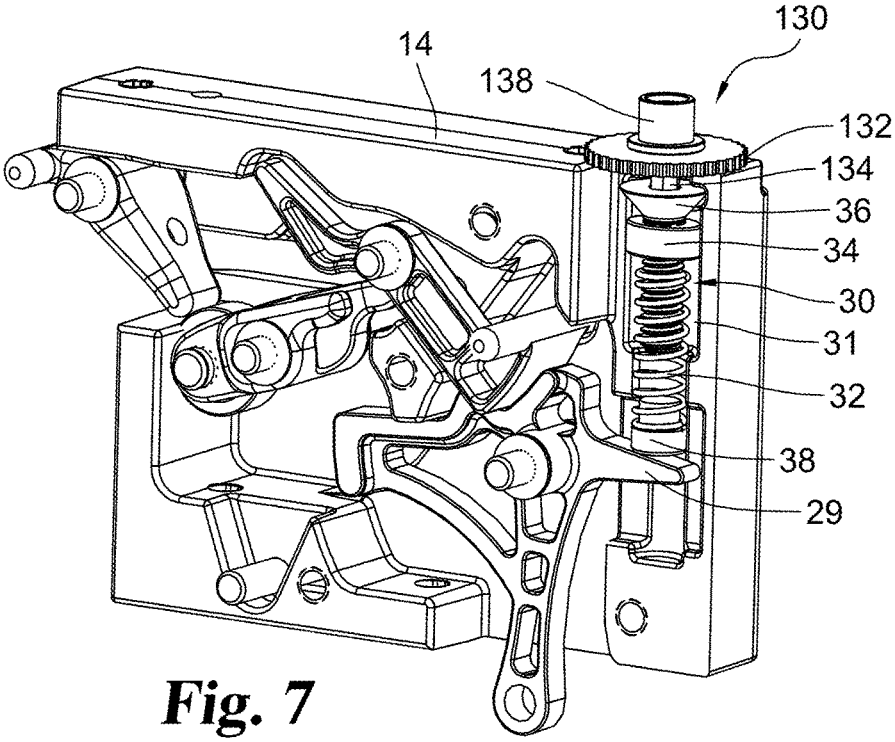
FIG. 7 is a perspective view of the trigger pull weight adjustment mechanism of FIG. 6.
Figure 8:
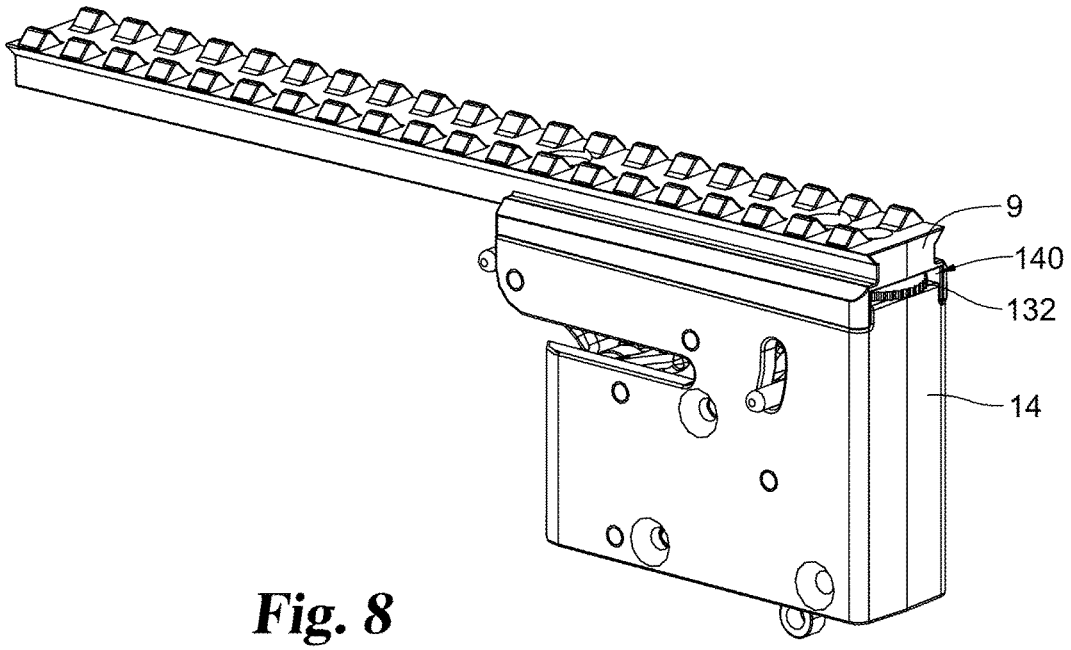
FIG. 8 is a perspective exterior view of the trigger pull weight adjustment mechanism of FIG. 6.

Other embodiments may include alternative methods for adjusting the force that pusher member 38 puts on rearward flange 29. For example, instead of being adjustable from the top of housing 14, adjustment mechanism 30 may be accessible from the side or rear of housing 14. FIGS. 6-8 show an example of an alternative embodiment of adjustment mechanism 30 that is accessible from the rear of housing 14 and allows the position of adjustment piece 36 to be changed without a tool. In this embodiment, as seen in FIG. 6, adjustment mechanism 30 includes a wheel adjustment assembly 130. Wheel adjustment assembly 130 includes a wheel 132, a driver portion 134, and an upper extension 136. Upper extension 136 fits within a bearing 138.

Wheel adjustment assembly 130 is positioned in housing 14, above adjustment piece 36, so that driver portion 134 engages adjustment piece 36, for example in a hex drive engagement (see FIG. 7). Upper extension 136 is positioned within bearing 138, allowing adjustment assembly 130 to rotate. When assembled in the stock, rail 9 covers the top portion of wheel 132 and bearing 138, while a rearward opening 140 defined between rail 9 and housing 14 leaves a portion of wheel 132 exposed (see FIG. 8) to allow access to an operator. When wheel 132 is rotated by an operator, driver 134 causes adjustment piece 36 to rotate and thus adjusts the position of stop 34. Adjusting the position of stop 34 changes the preload force on spring 32, which, in turn, changes the trigger pull weight.

Some embodiments may include an adjustable gear system used to adjust the compressive force on pusher member 38. Other embodiments may include additional features such as an indexed adjustment system and/or an external indicator that shows a user what trigger pull weight adjustment mechanism 30 has been adjusted to.

As shown in FIG. 3, cable catch assembly 40 resides in housing 14 forward of trigger mechanism 20. Cable catch assembly 40 includes a string nut 42 rotatably attached to housing 14 at cable catch pivot 44. A spring pin 46 is located on the lower portion of string nut 42. Spring pin 46 provides an attachment for one end of spring 47 on string nut 42. The other end of spring 47 is attached to spring pin 48, located below string nut 42 and attached to housing 14. Spring 47 urges string nut 42 into a generally vertical default orientation. A rotatable bearing 49 is mounted to the lower end of string nut 42, for example, on spring pin 46. Bearing 49 abuts forward edge 28 of sear 25 and limits counter-clockwise rotation of string nut 42 when trigger mechanism 20 is in a non-firing position. The upper portion of string nut 42 has a set of prongs 52. A slot-like opening provides spacing between prongs 52. The opening is large enough to allow a bolt to fit into the slot-like opening between the prongs.

Safety mechanism 60 is positioned above trigger mechanism 20 and rearward of cable catch assembly 40. Safety mechanism 60 includes a safety lever 62 that is rotatably mounted to housing 14 at safety pivot 64. A safety control pin 66 is positioned at the rearward portion 63 of safety lever 62. For example, safety control pin 66 extends through slot 68 in housing 14 and may be used to control the safety mechanism. Pin 66 may slide within slot 68 when safety lever 62 rotates about pivot 64. In the position shown in FIG. 3, safety mechanism 60 is disengaged as rearward portion 63 is not in contact with sear 25, so sear 25 is enabled to rotate counter-clockwise around pivot 26.

Figure 9:
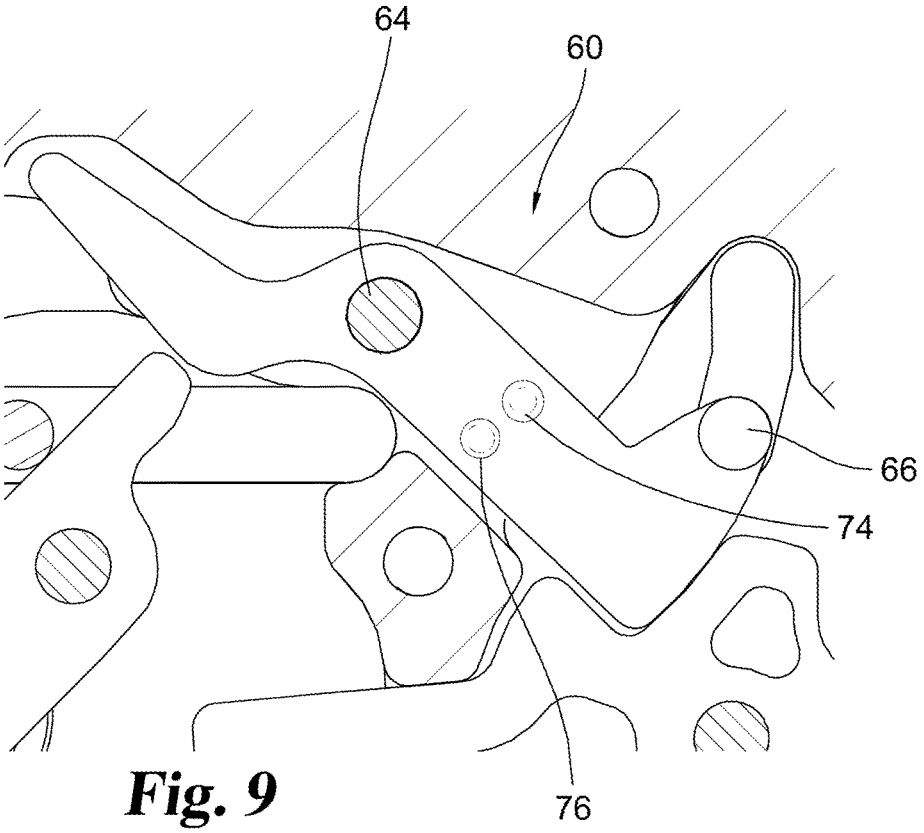
FIG. 9 is a side view of the safety mechanism of the trigger assembly of FIG. 2.
Figure 10:
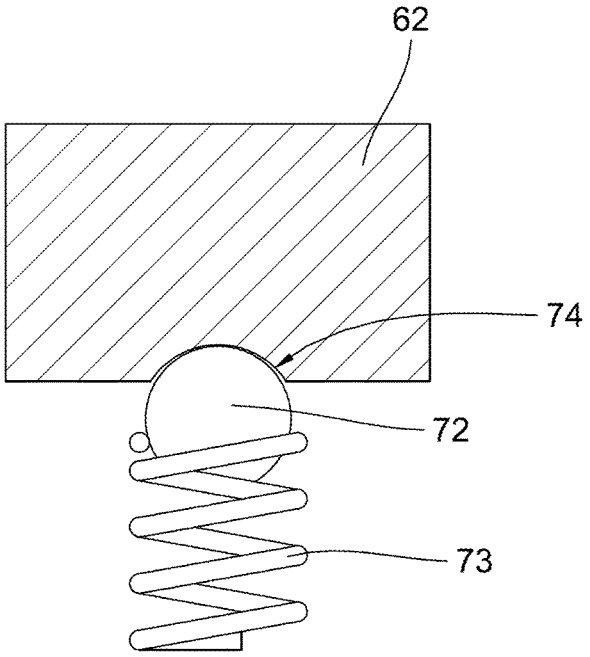
FIG. 10 is a side cross-sectional view of the safety mechanism of FIG. 6.

As seen in detail in FIGS. 9-10, safety lever 62 may be held in place by a ball/detent system. In the illustrated embodiment, a ball bearing 72 and spring 73 are positioned in housing 14 and bear on a side of lever 62, for example, between pivot 64 and pin 66. Spring 73 pushes ball bearing 72 into indent 74 or 76, temporarily locking safety lever 62 in place by resisting any movement of ball bearing 72 out of indent 74 or 76. When safety mechanism 60 is disengaged, ball bearing 72 is located in indent 76. When safety mechanism 60 is engaged, safety lever 62 rotates clockwise. Lever 62 pushes on ball bearing 72 to overcome the spring force so ball bearing 72 exits indent 76 and enters indent 74.

Anti-dry fire assembly 80 is located forward of cable catch assembly 40 and safety mechanism 60. If the bowstring cable 8 is loaded in trigger mechanism 10 and trigger 22 is pulled, an anti-dry fire lever 82 catches cable 8 as it is fired. When a bolt is loaded into trigger mechanism 10, anti-dry fire lever 82 is rotated counterclockwise and rests on top of the bolt allowing the bolt to be fired.

Figure 11:
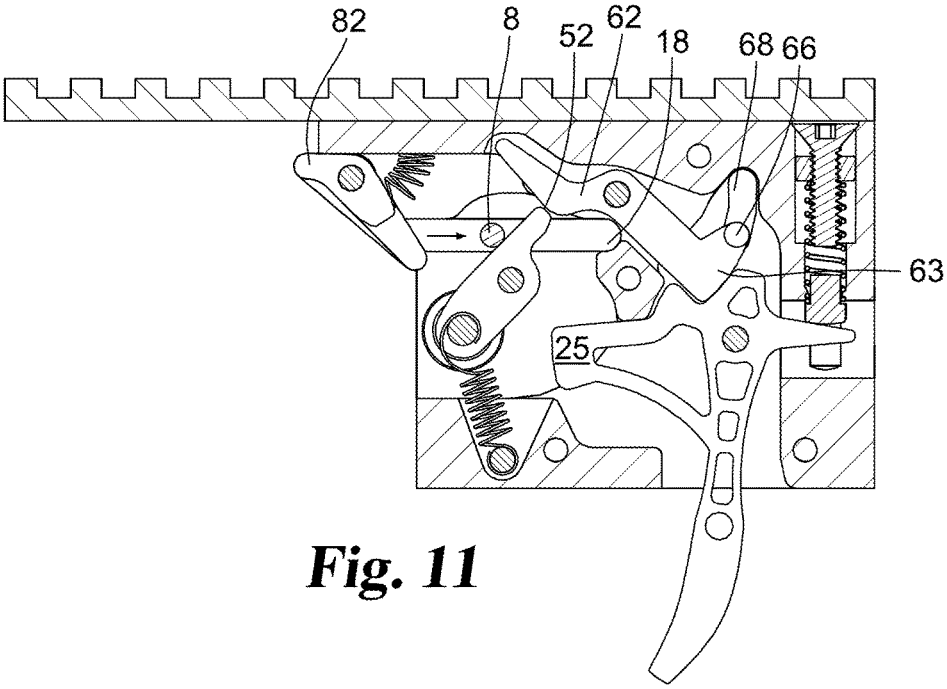
FIG. 11 is a side view of the trigger assembly of FIG. 2 in a cocking position.
Figure 12:
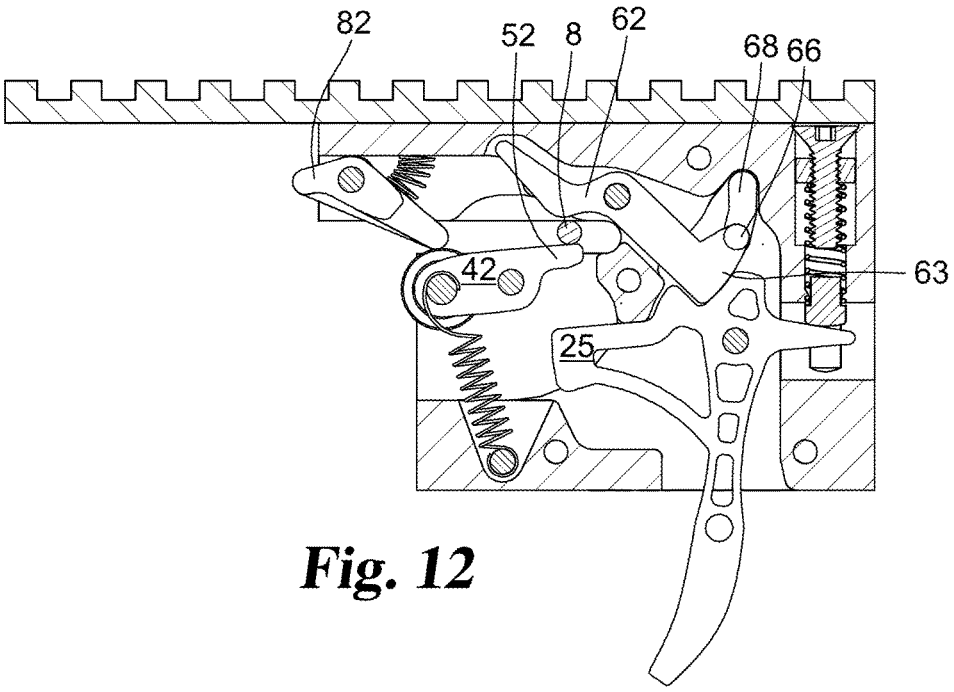
FIG. 12 is a side view of the trigger assembly of FIG. 2 in a cocking position.
Figure 13:
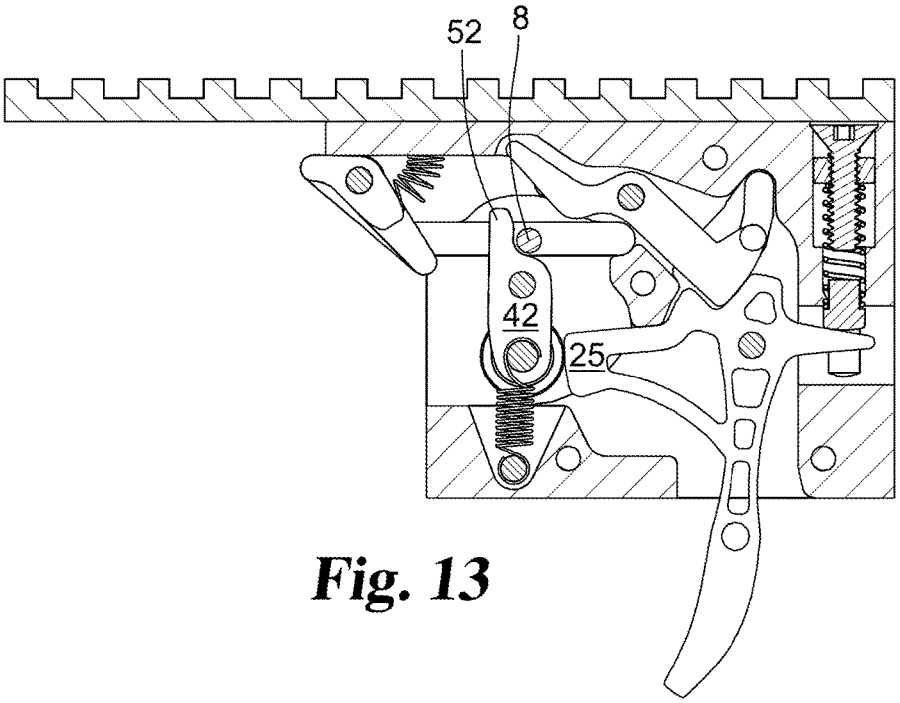
FIG. 13 is a side view of the trigger assembly of FIG. 2 in a cocked position with the safety engaged.

FIG. 11-12 show trigger mechanism 10 as it is being cocked. As bowstring cable 8 is pulled rearward, it passes under anti-dry fire lever 82. Bowstring cable 8 then contacts string nut 42 and causes string nut 42 to rotate clockwise as cable 8 is pulled rearward. As the string nut rotates, the upper portions of prongs 52 contact safety lever 62, engaging safety mechanism 60 by causing safety lever 62 to rotate clockwise. As safety lever 62 rotates, pin 66 slides within slot 68, and rearward portion 63 of lever 62 comes into contact with sear 25. In this position, safety mechanism 60 is engaged, as rearward portion 63 prohibits sear 25 from rotating.

Bowstring cable 8 is pulled rearward until it reaches the end of bowstring cable slot 18. Once cable 8 has cleared prongs 52 of string nut 42, spring 47 biases string nut 42 back to the upright position abutting sear 25 as shown in FIG. 3. As the draw force is released, cable 8 will bias forward and come to rest against prongs 52 of string nut 42 (see FIG. 13).

Figure 14:
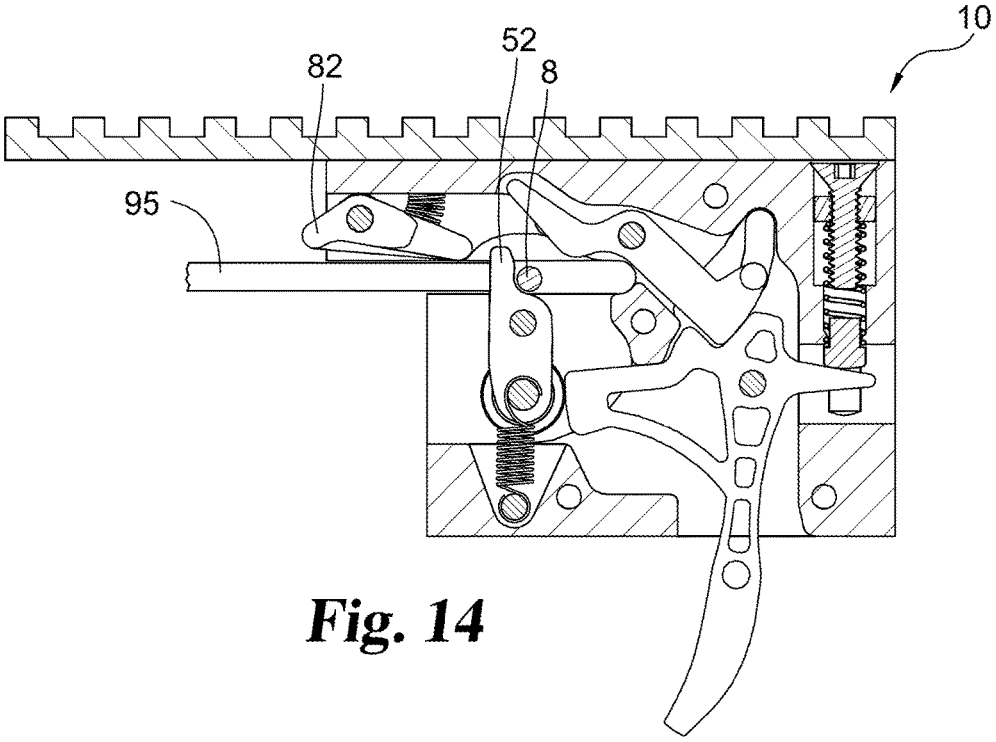
FIG. 14 is a side view of the trigger assembly of FIG. 2 in a cocked position with the safety engaged and a bolt loaded.

After crossbow 2 has been cocked, a bolt 95 may be loaded into trigger assembly 10 (see FIG. 14). The rearward end of bolt 95 is pushed rearward against anti-dry fire lever 82 so lever 82 rotates counterclockwise and compresses spring 86. Bolt 95 is slid between prongs 52 so bowstring cable 8 engages the nock of bolt 95.

Figure 15:
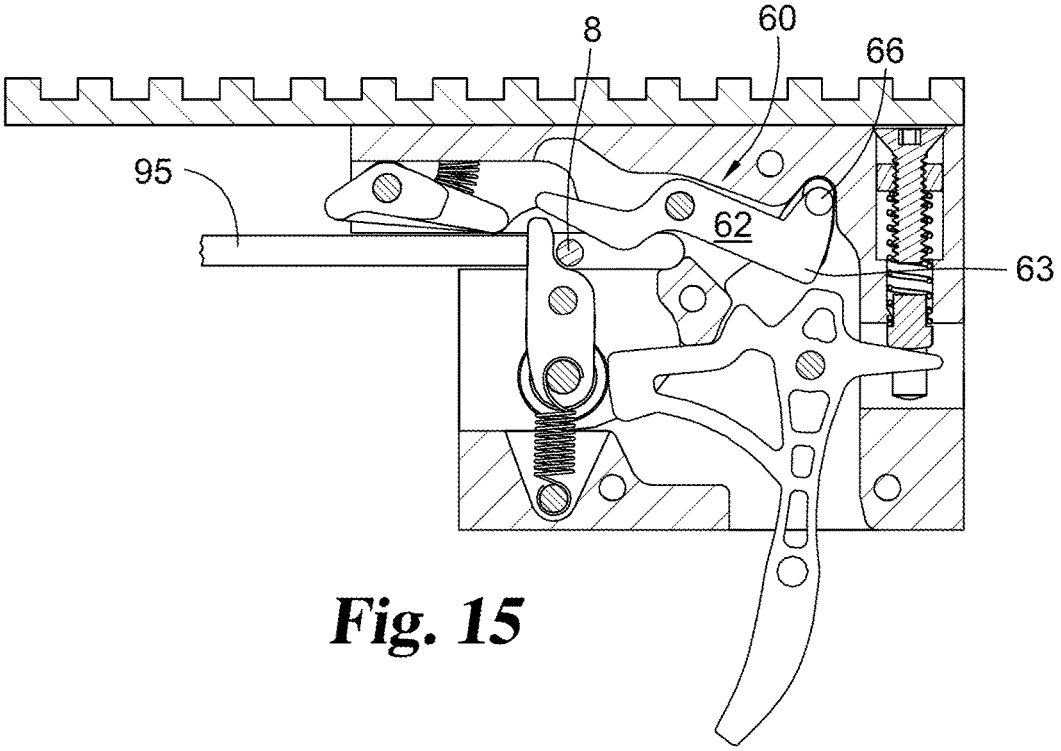
FIG. 15 is a side view of the trigger assembly of FIG. 2 in a cocked position with the safety disengaged and a bolt loaded.
Figure 16:
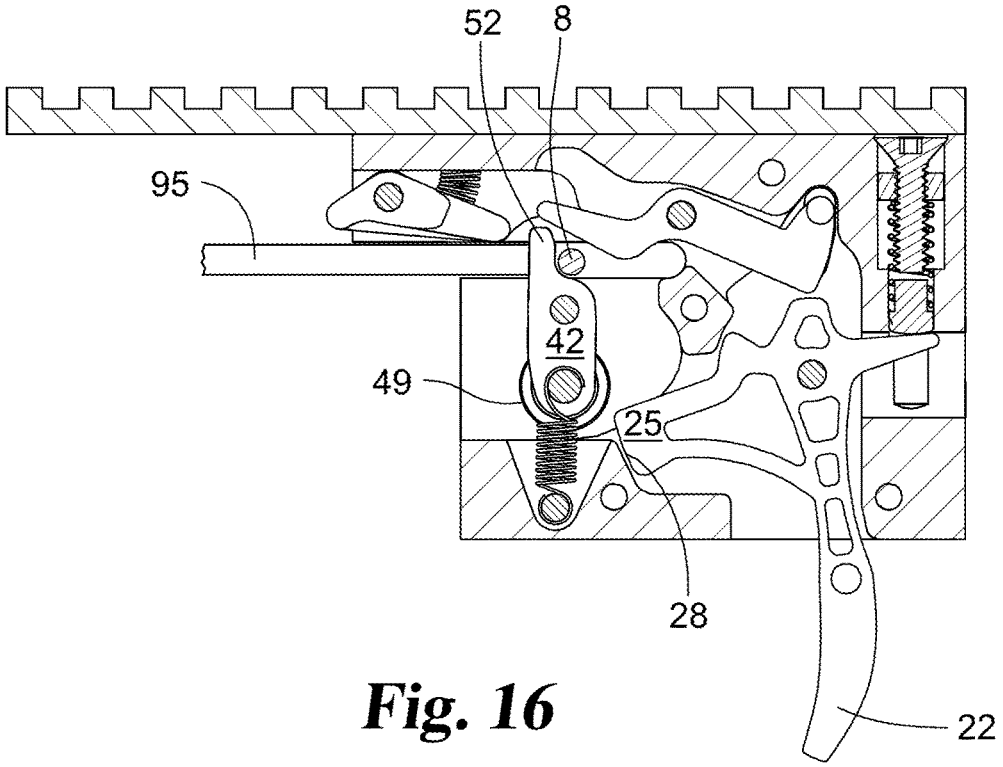
FIG. 16 is a side view of the trigger assembly of FIG. 2 as the trigger is being pulled.
Figure 17:
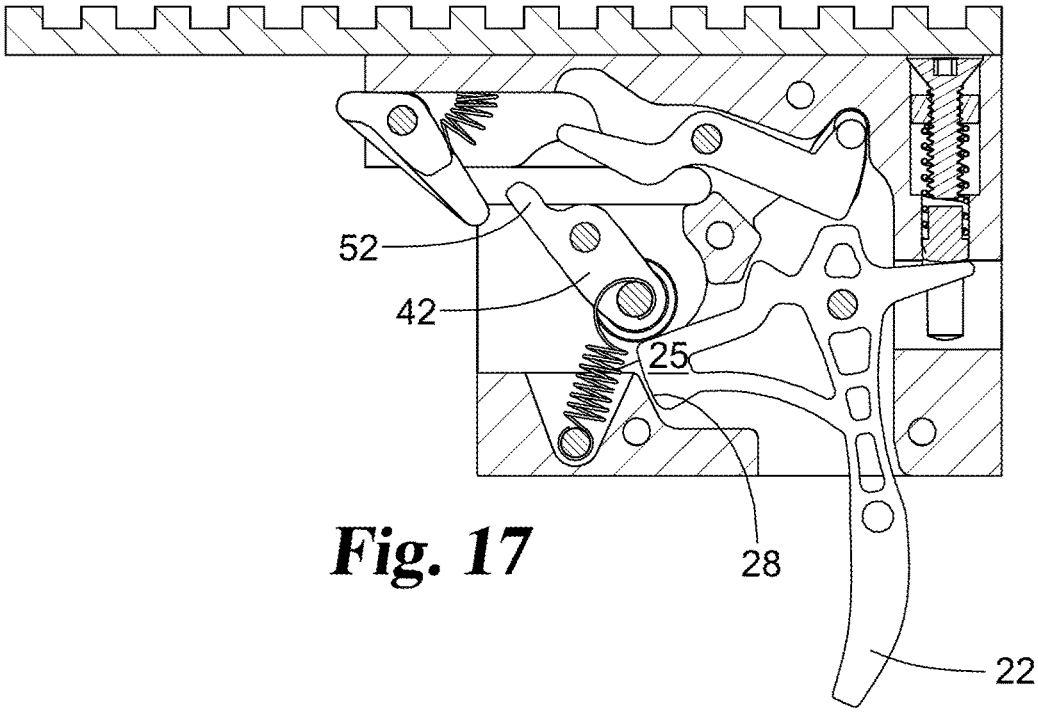
FIG. 17 is a side view of the trigger assembly of FIG. 2 after the trigger has been pulled.

Before firing the bolt, the user must disengage safety mechanism 60. As seen in FIGS. 2 and 15, to disengage safety mechanism 60, a user pushes upward on control pin 66, causing safety lever 62 to rotate counterclockwise. An opening in housing 14 gives the user access to control pin 66. Rotating safety lever 62 counterclockwise causes rearward portion 63 to disengage from sear 25 and enables sear 25 to rotate.

When a user pulls trigger 22, sear 25 rotates counterclockwise. The rotation of sear 25 causes forward edge 28 to roll along the surface of bearing 49 until sear 25 disengages from bearing 49 (see FIG. 16). The force of bowstring cable 8 pulls against prongs 52 of string nut 42 and causes string nut 42 to rotate counterclockwise and release cable 8 (see FIG. 17). Spring 47 returns string nut 42 to its vertical orientation, allowing sear 25 to reset as urged by pusher member 38.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. An assembly comprising:
- a crossbow stock;
- a pair of limbs extending from respective sides of said stock;
- a bowstring cable extending between said limbs;
- a trigger assembly arranged with said stock and operable to hold and release said bowstring cable from a drawn position;
- said trigger assembly having;
  - a cable catch assembly;
  - a trigger mechanism including a trigger selectively operable in a pull direction to release said cable catch assembly to release the bowstring cable;
  - a trigger pull weight adjustment mechanism including a pusher member biased by a resilient force against a portion of said trigger mechanism against said pull direction; an adjustable stop; and a resilient member arranged in compression between said stop and said pusher member, and wherein the position of said stop is movable to adjust the resilient force applied by said resilient member against said pusher member;
  - to change the trigger pull weight of said trigger.

2. The assembly of claim 1, wherein said resilient member is a compressible spring.

3. The assembly of claim 2, wherein said adjustable stop is vertically adjustable.

4. The assembly of claim 2, comprising an adjustment piece engaged with said stop, wherein said adjustable piece is operable by a user to control the position of said stop.

5. The assembly of claim 4, wherein said adjustment piece is threadably engaged with said stop.

6. The assembly of claim 5, wherein the assembly defines an access hole that allows a user to insert a tool to access said adjustment piece to control the position of said stop.

7. The assembly of claim 6, wherein said access hole is defined in a top surface of the assembly.

8. The assembly of claim 5, comprising a wheel adjustment assembly engaged with said adjustment piece, wherein said wheel adjustment assembly can be manually turned by a user from the exterior of the assembly.

9. The assembly of claim 4, wherein said adjustment piece is fixed in height relative to a housing for said trigger assembly.

10. The assembly of claim 4, wherein said adjustment piece extends partially through said spring.

11. The assembly of claim 2, wherein said trigger mechanism includes a sear with a rearward extending flange, and wherein said pusher member abuts said rearward extending flange.

12. The assembly of claim 2, wherein said pusher member is arranged to move in a vertical channel against the resilient force when said trigger mechanism is operated.

13. The assembly of claim 1, wherein said stop is constrained to prevent the stop from rotating.

14. A trigger assembly mountable with a crossbow stock, comprising:
- a cable catch assembly;
- a trigger mechanism including a trigger selectively operable in a pull direction to release said cable catch assembly to release a crossbow bowstring cable;
- a trigger pull weight adjustment mechanism including a pusher member bracing a portion of said trigger mechanism against said pull direction;
- a compressible spring which applies a resilient biasing force against said pusher member; and an adjustable stop, wherein said spring is arranged in compression between said stop and said pusher member, and wherein the position of said stop is movable to adjust the biasing force applied by said spring against said pusher member to change the trigger pull weight of said trigger.

15. The assembly of claim 14, comprising an adjustment piece engaged with said stop, wherein said adjustable piece is operable by a user to control the position of said stop.

16. The assembly of claim 14, wherein said trigger mechanism includes a sear with a rearward extending flange, wherein said pusher member abuts said rearward extending flange.

17. The assembly of claim 14, wherein said pusher member is arranged to move in a vertical channel against the biasing force when said trigger is operated.

18. An assembly comprising:
- a crossbow stock;
- a pair of limbs extending from respective sides of said stock;
- a bowstring cable extending between said limbs;
- a trigger mechanism mounted in a housing arranged in said stock and being selectively operable in a pull direction to release the bowstring cable;

an adjustable stop;

a compressible spring arranged between said adjustable stop and said trigger mechanism and resiliently biasing said trigger mechanism against said pull direction;

said stop is selectively adjustable to control the biasing force of said spring against said trigger mechanism; and, an adjustment piece arranged at a fixed height relative to said housing and usable to selectively adjust said stop.

19. The assembly of claim 18, wherein said stop can be adjusted by a user using a tool inserted through a defined access hole.

20. The assembly of claim 18, comprising a wheel adjustment assembly operably engaged with said stop, wherein said wheel adjustment assembly can be manually turned by a user to adjust the position of said stop.

* * * * *